US007004082B2

(12) United States Patent
Yang

(10) Patent No.: US 7,004,082 B2
(45) Date of Patent: Feb. 28, 2006

(54) OUTDOOR TABLE, OUTDOOR TABLE AND CHAIR SET

(76) Inventor: Jim Chi Hsiang Yang, 17900 Gard Ave., Artesia, CA (US) 90701

( * ) Notice: Subject to any disclaimer, the term of this patent is extended or adjusted under 35 U.S.C. 154(b) by 335 days.

(21) Appl. No.: 10/437,020

(22) Filed: May 14, 2003

(65) Prior Publication Data

US 2004/0226487 A1 Nov. 18, 2004

(51) Int. Cl.
*A47B 37/00* (2006.01)

(52) U.S. Cl. ..... 108/50.12; 108/65; 108/90

(58) Field of Classification Search ..... 108/50.12, 108/26, 64, 65, 66, 90, 158.12, 185; 135/15.1, 135/16

See application file for complete search history.

(56) References Cited

U.S. PATENT DOCUMENTS

| | | | | | |
|---|---|---|---|---|---|
| 3,241,885 | A | * | 3/1966 | Deaton | 108/64 |
| 3,688,707 | A | * | 9/1972 | White | 108/90 |
| 4,192,083 | A | * | 3/1980 | Rebbeck | 108/64 |
| 4,559,877 | A | * | 12/1985 | Waibel | 108/64 |
| 4,656,953 | A | * | 4/1987 | Miller, Jr. | 108/64 |
| 5,086,712 | A | * | 2/1992 | Clark | 108/50.12 |
| 5,197,394 | A | * | 3/1993 | Schmidt | 108/50.12 |
| 5,438,937 | A | * | 8/1995 | Ball et al. | 108/64 |
| 5,697,305 | A | * | 12/1997 | Chasan et al. | 108/90 |
| 6,032,590 | A | * | 3/2000 | Chen | 108/158.12 |
| 6,367,392 | B1 | * | 4/2002 | Moore | 108/90 |

FOREIGN PATENT DOCUMENTS

| | | | | |
|---|---|---|---|---|
| EP | 20137 | * | 12/1980 | |
| EP | 517615 | * | 12/1992 | |
| JP | 05146316 | * | 6/1993 | 108/66 |

* cited by examiner

*Primary Examiner*—Lanna Mai
*Assistant Examiner*—Hanh V. Tran
(74) *Attorney, Agent, or Firm*—Rosenberg, Klein & Lee

(57) ABSTRACT

An outdoor table and chair set in which the tabletop of the table is constructed to include a plurality of polygonal tabletop box panels abutted against one another and defining a center hole for the mounting of the shank of a parasol, each tabletop box panel having a polygonal open chamber, a plurality of frames respectively detachably mounted in the polygonal open chambers of the polygonal tabletop box panels, and a plurality of ornamental glass cover plates respectively detachably mounted in the frames.

11 Claims, 7 Drawing Sheets

OUTDOOR TABLE, OUTDOOR TABLE AND CHAIR SET

BACKGROUND OF THE INVENTION

1. Field of the Invention

The present invention relates to outdoor tables and chairs, more particularly, to an outdoor table and chair se, in which the tabletop of the table is formed of a combination of triangular tabletop box panels each decorated with a frame packed ornamental glass cover plate.

2. Description of the Related Art

Conventional outdoor tables are commonly made of metal, plastics, or wooden material, and have a circular or rectangular shape. Because conventional outdoor tables do not provide a variable pattern, they are monotonous and not attractive.

SUMMARY OF THE INVENTION

The present invention has been accomplished under the circumstances in view. According to one aspect of the present invention, the tabletop of the outdoor table is comprised of a plurality of triangular tabletop box panels abutted against one another. According to another aspect of the present invention, each triangular tabletop box panel has a polygonal open chamber at the center adapted to hold a detachable frame and an ornamental glass cover plate in the detachable frame. The user can replace the ornamental glass cover plates to change the design of the tabletop. According to still another aspect of the present invention, hanging frames are provided for hanging ornamental glass cover plates on the wall when ornamental glass cover plates removed from the tabletop.

DETAILED DESCRIPTION OF THE PREFERRED EMBODIMENT

Figure 1:
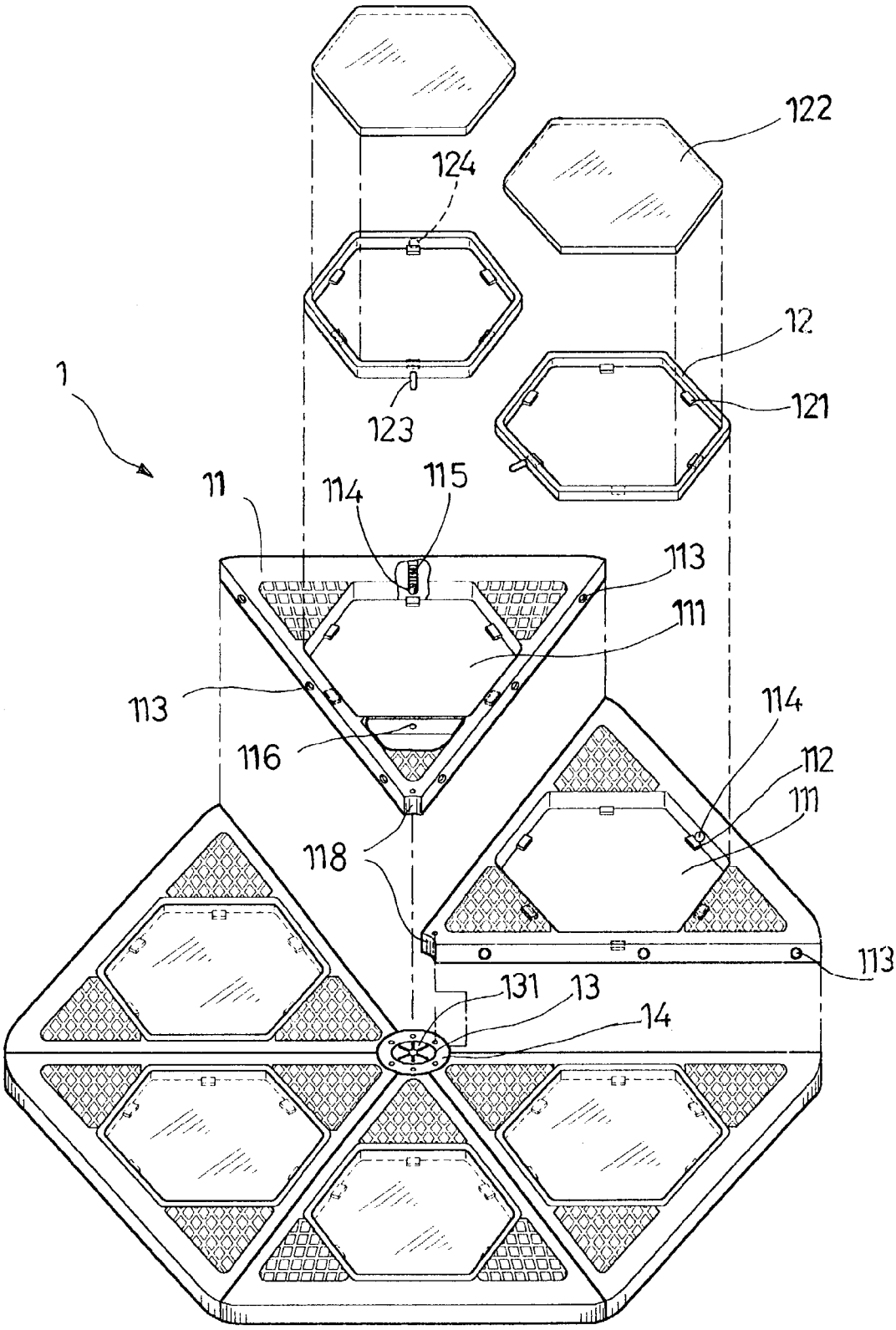
FIG. 1 is an exploded view of the tabletop for an outdoor table according to the present invention.
Figure 2A:
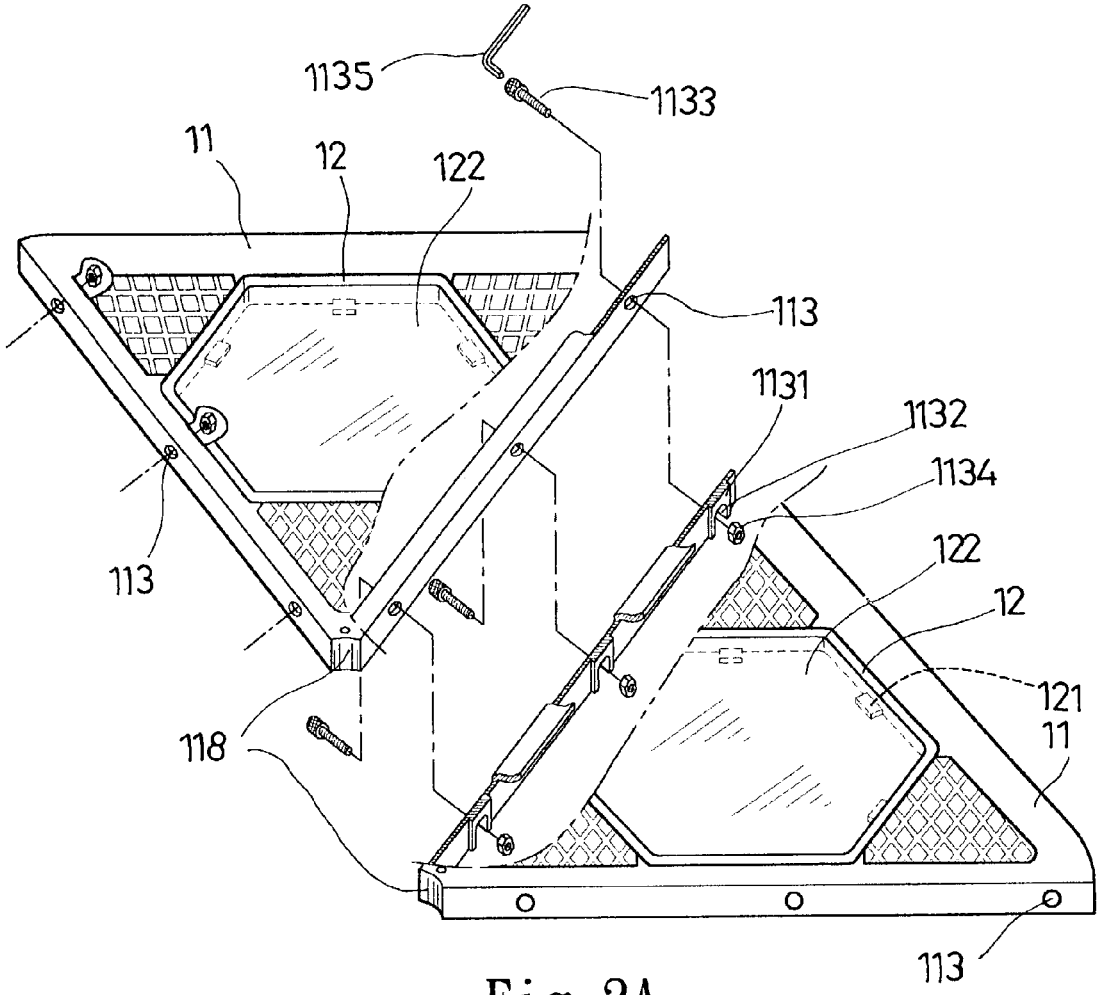
FIG. 2A is a schematic drawing showing the mounting arrangement between two triangular tabletop box panels according to the present invention.
Figure 2B:
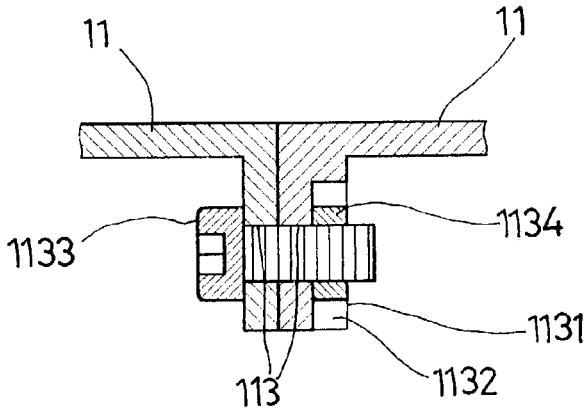
FIG. 2B is a sectional view showing a screw and a nut fastened to two triangular tabletop box panels according to the present invention.
Figure 3:
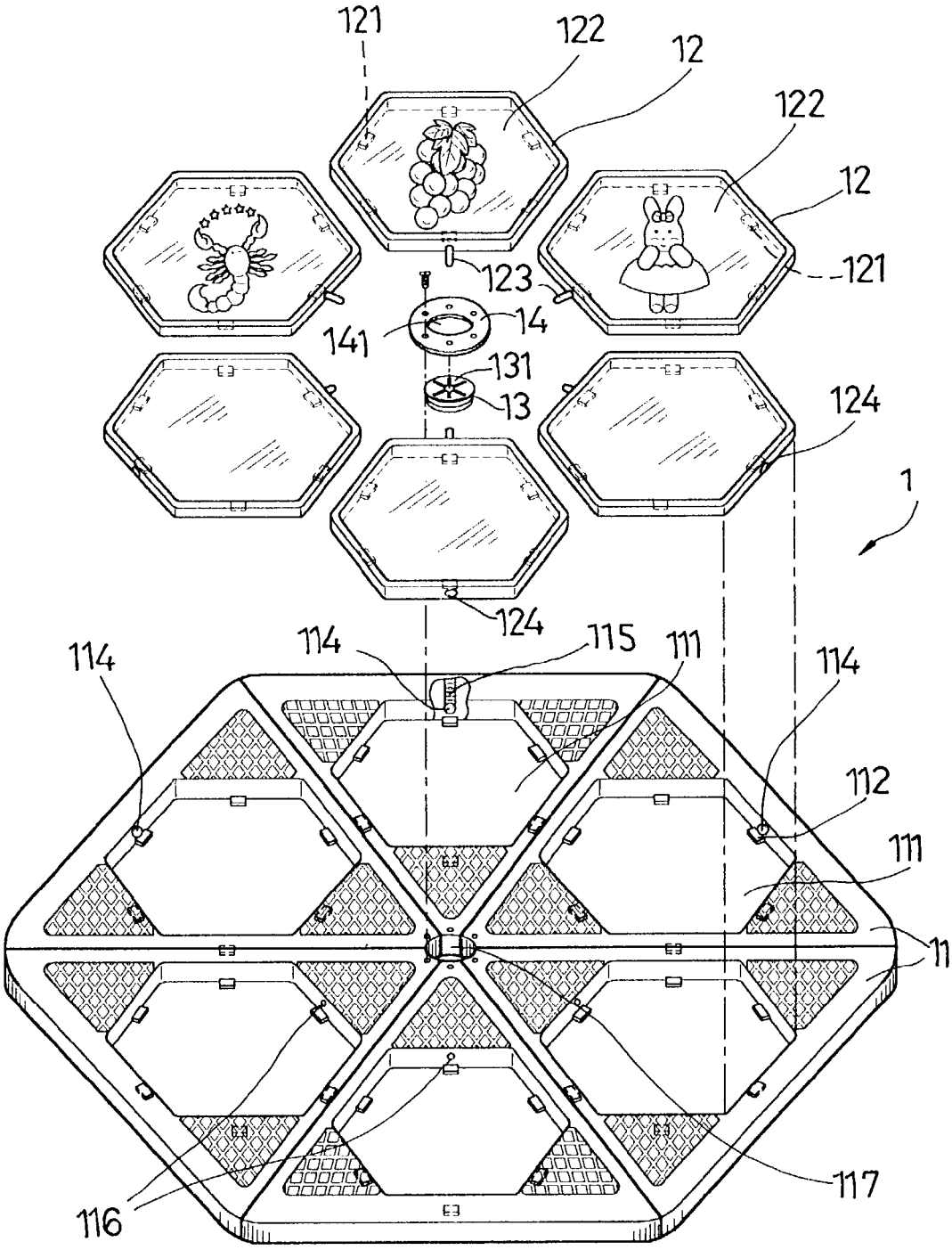
FIG. 3 is another exploded view of the tabletop according to the present invention.
Figure 4:
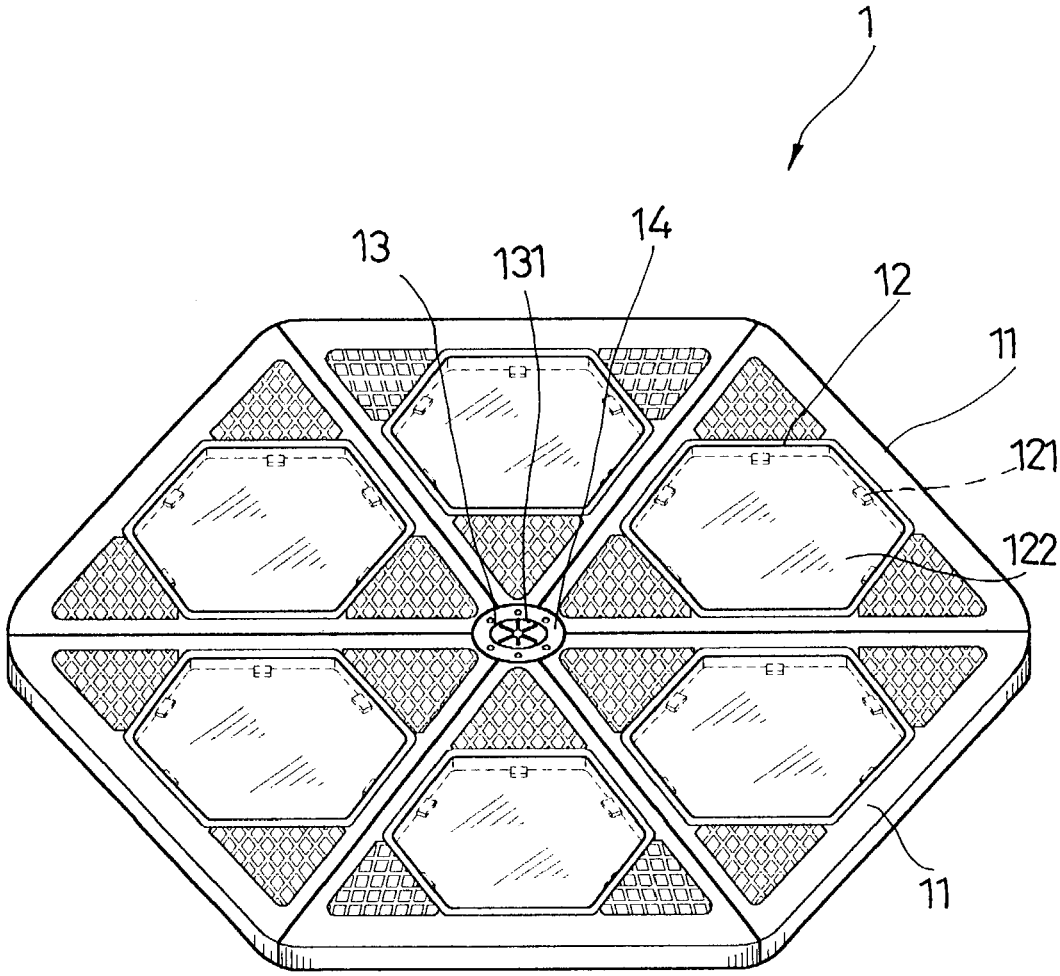
FIG. 4 is an elevational assembly view of the tabletop according to the present invention.
Figure 5:
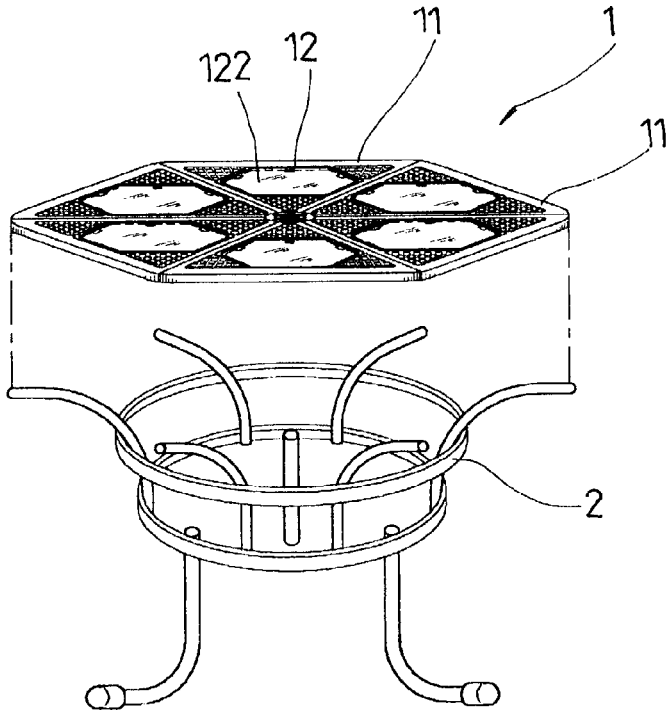
FIG. 5 is an exploded view of the outdoor table according to the present invention.

Referring to FIGS. 1, 2A, 2B, 3, 4 and 5, an outdoor table in accordance with the present invention is shown comprised of a stand 2 and a tabletop 1 supported on the stand 2 (see FIG. 5). The tabletop 1 comprises a plurality of triangular tabletop box panels 11. The triangular tabletop box panels 11 are abutted against one another, forming a polygonal pattern. Each triangular tabletop box panel 11 comprises a plurality of horizontal mounting holes 113 symmetrically formed in two adjacent sides thereof. Each horizontal mounting hole 113 in one side of one triangular tabletop box panel 11 is fastened to the corresponding horizontal mounting hole 113 in the abutting side of another triangular tabletop box panel 11 by a screw 1133 and a nut 1134. Each triangular tabletop box panel 11 has a polygonal open chamber 111 at the center adapted to accommodate a polygonal frame 12, which is detachably mounted in the polygonal open chamber 111. Locating lugs 112 are provided inside the polygonal open chamber 111 and adapted to support the corresponding polygonal frame 12 in place. Further, an ornamental cover plate 122 is detachably fitted into the polygonal frame 12 and maintained in flush with the top side of the polygonal frame 12. Locating lugs 121 are provided inside each polygonal frame 12 to support a respective ornamental cover plate 122 in each polygonal frame 12. The ornamental cover plate 122 can be a glass plate, acrylic plate, wooden plate, or metal plate, having a printed or engraved pattern or design in it. The invention also provides a hanging frame 3. The hanging frame 3 is similar to the polygonal frame 12 and adapted to hang one ornamental cover plate 122 on the wall, having an eyepiece 31 at the periphery for hanging.

Each triangular tabletop box panel 11 comprises a plurality of inside protruding blocks 1131 respectively disposed on the inside around the mounting holes 113. Each inside protruding block 1131 has an opening 1132 adapted to accommodate one nut 1134. Therefore, the user can conveniently drive a screw 1133 into the nut 1134 with a wrench 1135 to fix two triangular tabletop box panels 11 together.

Figure 6:
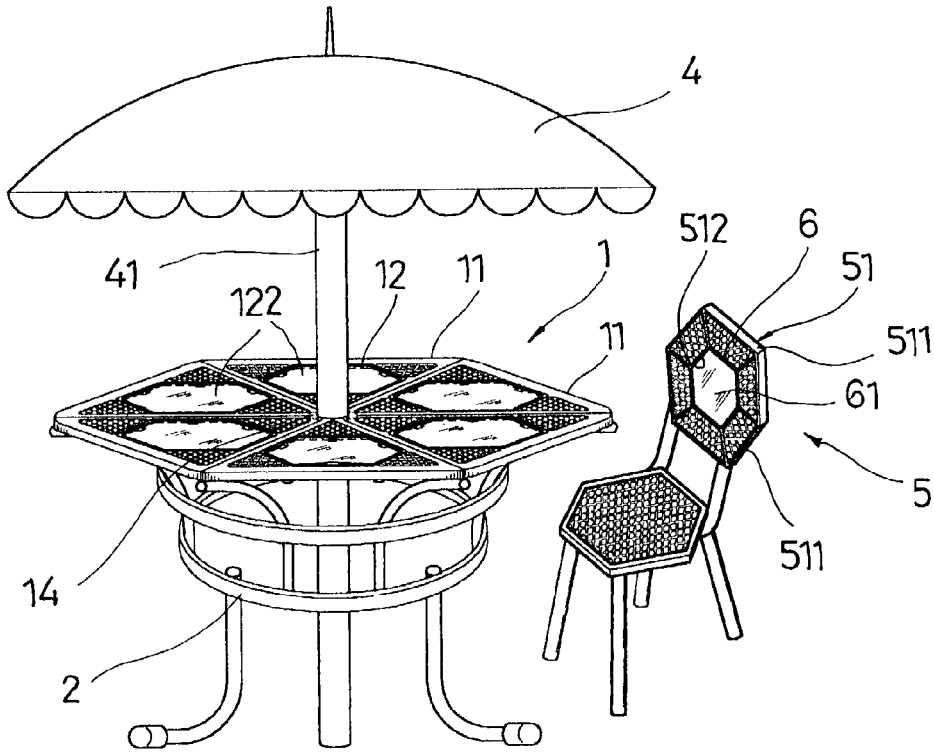
FIG. 6 shows a parasol fastened to the outdoor table and the use a matching chair with the outdoor table.

Referring to FIG. 6 and FIGS. 3 and 4, the top end 118 of each triangular tabletop box panel 11 (where the two sides of the respective triangular tabletop box panel 11 met) is smoothly curved inwards. When the triangular tabletop box panels 11 fastened together, the inwardly curved top ends 118 of the triangular tabletop box panels 11 define a center hole 117 for the mounting of a parasol 4. A split ring 13 is press-fitted into the center hole 117, having a plurality of radially inwardly projecting spring strips 131. When the shank 41 of the parasol 4 inserted through the split ring 13 and the center hole 117, the spring strips 131 are stopped against the periphery of the shank 41 of the parasol 4, holding the parasol 4 in position. Further, a packing ring 14 is fastened to the center hole 117 and supported on the split ring 13, keeping the center hole 141 of the packing ring 14 in axial alignment with the center hole 117.

Referring to FIGS. 1 and 3 again, each triangular tabletop box panel 11 further comprises a horizontal plughole 116 in one upright peripheral side of the polygonal open chamber 111, and a steel ball 115 supported on a compression spring 114 at an opposite upright peripheral side of the polygonal open chamber 111. Each polygonal frame 12 has a pin 123 and a locating hole 124 at two sides. One polygonal frame 12 is installed in the polygonal open chamber 111 of the corresponding triangular tabletop box panel 11 by engaging the pin 123 of the polygonal frame 12 into the plughole 116 in the triangular tabletop box panel 11 and then pressing the polygonal frame 12 downwards into the inside of the polygonal open chamber 111 to force the locating hole 124 into engagement with the steel ball 115. When pushing the polygonal frame 12 upwards by force from the bottom side to disengage the locating hole 124 from the steel ball 115, the polygonal frame 12 can then conveniently be removed from the polygonal tabletop box panel 11.

Figure 7:
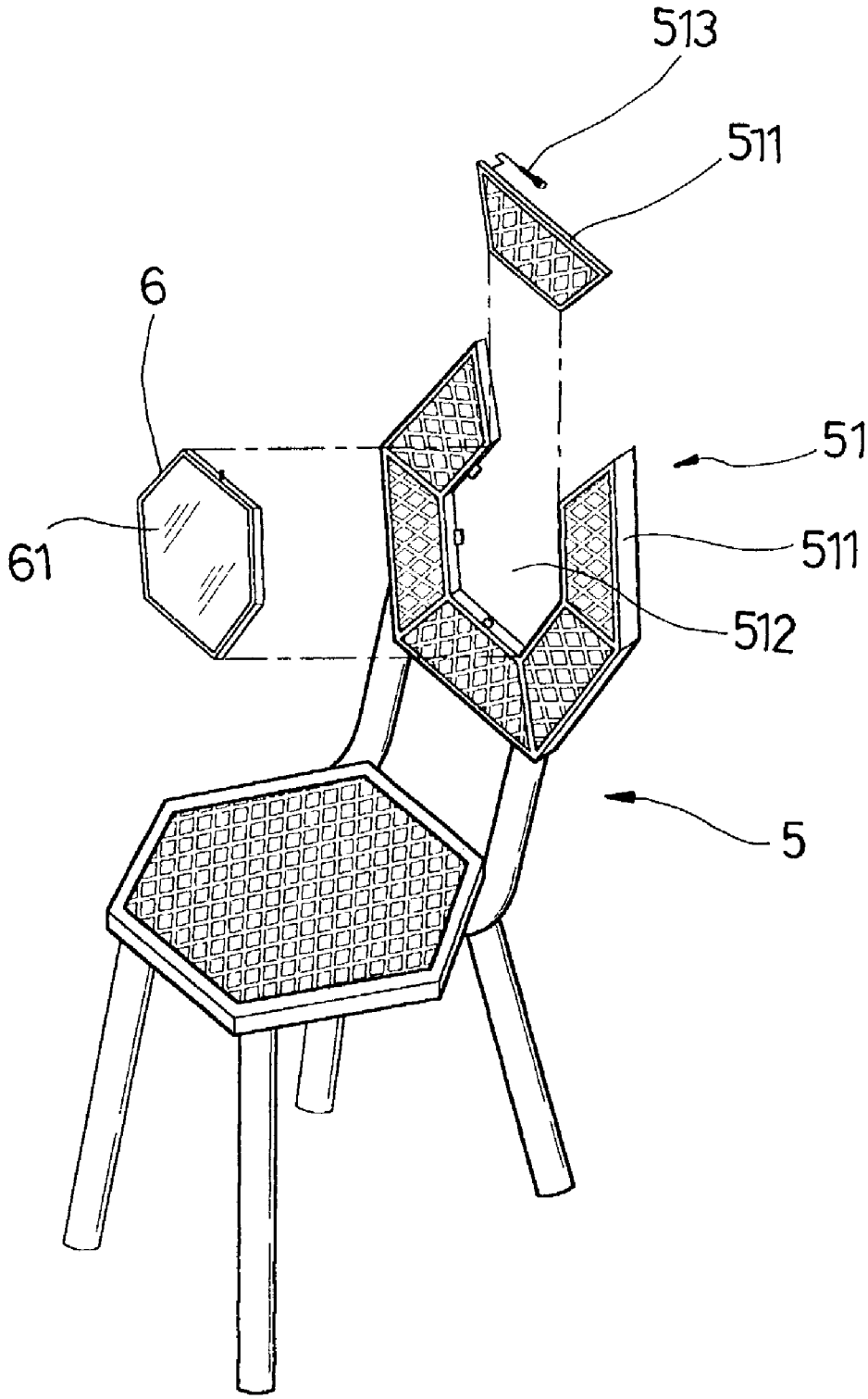
FIG. 7 is an exploded view in an enlarged scale of the chair shown in FIG. 6.
Figure 8:
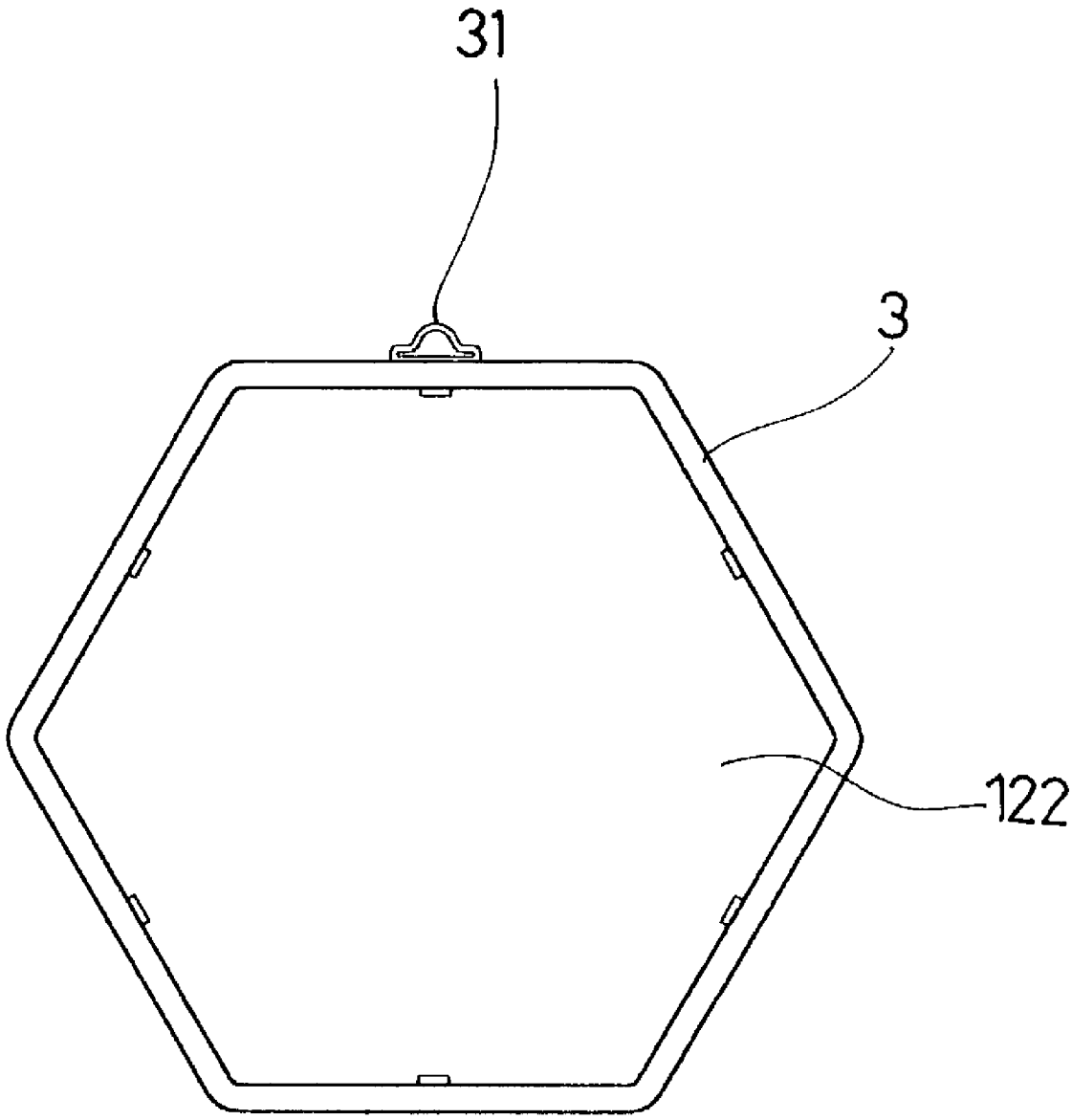
FIG. 8 illustrates a hanging frame mounted with an ornamental cover plate and hung on the wall according to the present invention.

Referring to FIGS. 6 and 7, the chair 5 has a back 51 (or seat) constructed in the same manner as the aforesaid tabletop 1, i.e., the back 51 is comprised of a plurality of base panels 511 fixedly secured to one another by screws 513. The base panels 511 define a center opening 512 adapted to accommodate a frame 6, which holds an ornamental cover plate 61. The design of the ornamental cover plate 61 fits the ornamental cover plate 122 of each triangular tabletop box panel 11 of the tabletop 1.

A prototype of outdoor table has been constructed with the features of the annexed drawings of FIGS. 1~8. The outdoor table functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims What the invention claimed is:

1. An outdoor table and chair set comprising a table and a plurality of chairs, wherein said table comprises:

a stand;

a tabletop supported on said stand, said tabletop comprising a plurality of polygonal tabletop box panels abutted against one another and a center hole defined by a respective inwardly curved top end of each of said polygonal tabletop box panels for the mounting of the shank of a parasol, said polygonal tabletop box panels each having a plurality of mounting holes in two adjacent sides thereof and a polygonal open chamber, the mounting holes in one side of one of said polygonal tabletop box panels being respectively fastened to the mounting holes in one side of another of said polygonal tabletop box panel panels by a respective screw and nut;

a plurality of frames respectively detachably mounted in the polygonal open chambers of said polygonal tabletop box panels; and a plurality of ornamental glass cover plates respectively mounted in said frames, said ornamental glass cover plates each having a design.

2. The outdoor table and chair set as claimed in claim 1, wherein said polygonal tabletop box panels each have a plurality of inside protruding blocks respectively disposed on the inside around the mounting holes of the respective polygonal tabletop box panel, said inside protruding blocks each having an opening adapted to accommodate one nut.

3. The outdoor table and chair set as claimed in claim 1, further comprising a split ring mounted in said center hole, and a packing ring mounted in said center hole and supported on said split ring in axial alignment with said center hole and said split ring.

4. The outdoor table and chair set as claimed in claim 1, wherein said chairs each comprises a back and a seat, said back and said seat each comprised of a plurality of base panels fixedly secured to one another by screws, a center opening surrounded by said base panels, a frame mounted in said center opening, and an ornamental cover plate mounted within said frame, said ornamental glass cover plate having a design.

5. The outdoor table and chair set as claimed in claim 1, wherein said polygonal tabletop box panels each comprise a plug hole and a spring-supported steel ball respectively disposed in two opposite sides in the respective polygonal open chamber, said frames each comprise a pin disposed at one side thereof and adapted to engage into the plughole in one polygonal tabletop box panel, and a locating hole disposed at an opposite side thereof and adapted to receive the spring-supported steel ball of one polygonal tabletop box panel.

6. The outdoor table and chair set as claimed in claim 1, further comprising a plurality of hanging frames shaped like the frames mounted in said polygonal tabletop box panels and adapted to hang said ornamental glass cover plates on a wall individually after removal of said ornamental glass cover plates from said table, said hanging frames each having a hanging hook.

7. An outdoor table comprising:

a tabletop, said tabletop comprising a plurality of polygonal tabletop box panels abutted against one another and a center hole defined by a respective inwardly curved top end of each of said polygonal tabletop box panels for the mounting of the shank of a parasol, said polygonal tabletop box panels each having a plurality of mounting holes in two adjacent sides thereof and a polygonal open chamber, the mounting holes in one side of one polygonal tabletop box panel being respectively fastened to the mounting holes in one side of another polygonal tabletop box panel by a respective screw and nut;

a plurality of frames respectively detachably mounted in the polygonal open chambers of said polygonal tabletop box panels;

a plurality of ornamental glass cover plates respectively mounted in said frames, said ornamental glass cover plates each having a design;

a split ring mounted in the center hole of said tabletop and adapted to hold the shank of a parasol, said split ring comprising a plurality of radially inwardly protruding springy ships.

8. The outdoor table as claimed in claim 7, wherein said polygonal tabletop box panels each have a plurality of inside protruding blocks respectively disposed on the inside around the mounting holes of the respective polygonal tabletop box panel, said inside protruding blocks each having an opening adapted to accommodate one nut.

9. The outdoor table and chair set as claimed in claim 7, wherein said polygonal tabletop box panels each comprise a plug hole and a spring-supported steel ball respectively disposed in two opposite sides in the respective polygonal open chamber, said frames each comprise a pin disposed at one side thereof and adapted to engage into the plughole in one polygonal tabletop box panel, and a locating hole disposed at an opposite side thereof and adapted to receive the spring-supported steel ball of one polygonal tabletop box panel.

10. An outdoor table comprising:

a stand;

a tabletop supported on said stand, said tabletop comprising a plurality of triangular tabletop box panels abutted against one another and a center hole defined by a respective inwardly curved top end of each of said triangular tabletop box panels for the mounting of the shank of a parasol, said triangular tabletop box panels each having a plurality of mounting holes in two adjacent sides thereof and a polygonal open chamber, the mounting holes in one side of one triangular tabletop box panel being respectively fastened to the mounting holes in one side of another triangular tabletop box panel by a respective screw and nut;

a plurality of frames respectively detachably mounted in the polygonal open chambers of said triangular tabletop box panels;

a plurality of ornamental glass cover plates respectively mounted in said frames, said ornamental glass cover plates each having a design;

a split ring mounted in the center hole of said tabletop and adapted to hold the shank of a parasol, said split ring comprising a plurality of radially inwardly protruding springy strips; and a packing ring mounted in the center hole of said tabletop and supported on said split ring.

11. The outdoor table as claimed in claim 10, wherein said triangular tabletop box panels each comprise a plug hole and a spring-supported steel ball respectively disposed in two opposite sides in the respective polygonal open chamber; said frames each comprise a pin disposed at one side thereof and adapted to engage into the plughole in one triangular tabletop box panel, and a locating hole disposed at an opposite side thereof and adapted to receive the spring-supported steel ball of one triangular tabletop box panel.

* * * * *